US009731426B2

(12) United States Patent
Kim et al.

(10) Patent No.: US 9,731,426 B2
(45) Date of Patent: Aug. 15, 2017

(54) ROTATING TYPE RAZOR

(71) Applicants: Hak Ho Kim, Seoul (KR); Gi Dong Kang, Gyeonggi-do (KR)

(72) Inventors: Hak Ho Kim, Seoul (KR); Gi Dong Kang, Gyeonggi-do (KR)

( * ) Notice: Subject to any disclaimer, the term of this patent is extended or adjusted under 35 U.S.C. 154(b) by 0 days.

(21) Appl. No.: 14/436,089

(22) PCT Filed: Aug. 29, 2013

(86) PCT No.: PCT/KR2013/007750
§ 371 (c)(1),
(2) Date: Apr. 16, 2015

(87) PCT Pub. No.: WO2014/061912
PCT Pub. Date: Apr. 24, 2014

(65) Prior Publication Data

US 2015/0283716 A1 Oct. 8, 2015

(30) Foreign Application Priority Data

Oct. 18, 2012 (KR) ..... 10-2012-0116235

(51) Int. Cl.
*B26B 21/52* (2006.01)
*B26B 21/22* (2006.01)
*B26B 21/40* (2006.01)

(52) U.S. Cl.
CPC ..... *B26B 21/521* (2013.01); *B26B 21/225* (2013.01); *B26B 21/4062* (2013.01)

(58) Field of Classification Search
CPC ..... B26B 21/521; B26B 21/52; B26B 21/225; B26B 21/4062
(Continued)

(56) References Cited

U.S. PATENT DOCUMENTS 831,259 A * 9/1906 Bingler ..... B26B 21/28 30/531
3,964,160 A 6/1976 Gordon
(Continued)

FOREIGN PATENT DOCUMENTS

CA 2443881 A1 * 4/2005 ..... B26B 19/38
DE 9207001 U1 * 8/1992 ..... B26B 21/225
(Continued)

OTHER PUBLICATIONS

English Translation of DE9207001.*
International Search Report for PCT/KR2013/007750 mailed Dec. 30, 2013 from Korean Intellectual Property Office.

*Primary Examiner* — Jennifer Swinney
(74) *Attorney, Agent, or Firm* — Lee Global Patent, LLC; Jake K. Lee

(57) ABSTRACT

Disclosed is a razor and, more particularly, a rotating type razor having a cartridge which is replaceable, rotatable and controllable in angle. To this end, the rotating type razor, which includes a handle provided at one side thereof, a head provided at the other side thereof, and a razor blade cartridge connected to the head, further includes a mover configured to rotate the razor blade cartridge. The razor blade cartridge is rotated by 180 degrees about the head as a rotation axis by the mover so as to be variable in position when shaving the upper jaw and when shaving the lower jaw in a state in which a body of the razor has a fixed orientation.

4 Claims, 8 Drawing Sheets

(58) Field of Classification Search
USPC ..... 30/527, 528, 529, 57, 58
See application file for complete search history.

(56) References Cited

U.S. PATENT DOCUMENTS

| | | | | | |
|---|---|---|---|---|---|
| 4,083,103 | A | | 4/1978 | Estandian | |
| 4,617,736 | A | * | 10/1986 | McCrary | B44D 3/162 30/169 |
| 5,093,991 | A | * | 3/1992 | Hendrickson | B26B 21/28 30/531 |
| 5,526,568 | A | | 6/1996 | Copelan | |
| 2005/0000100 | A1 | * | 1/2005 | Coffin | B26B 21/28 30/531 |
| 2007/0214647 | A1 | * | 9/2007 | Psimadas | B26B 21/22 30/42 |

FOREIGN PATENT DOCUMENTS

| | | | | | |
|---|---|---|---|---|---|
| DE | 19508873 | A1 | * | 2/1996 | B26B 21/28 |
| JP | 2008-506479 | A | | 3/2008 | |
| KR | 10-2009-0101309 | A | | 9/2009 | |

* cited by examiner

[Fig.1]
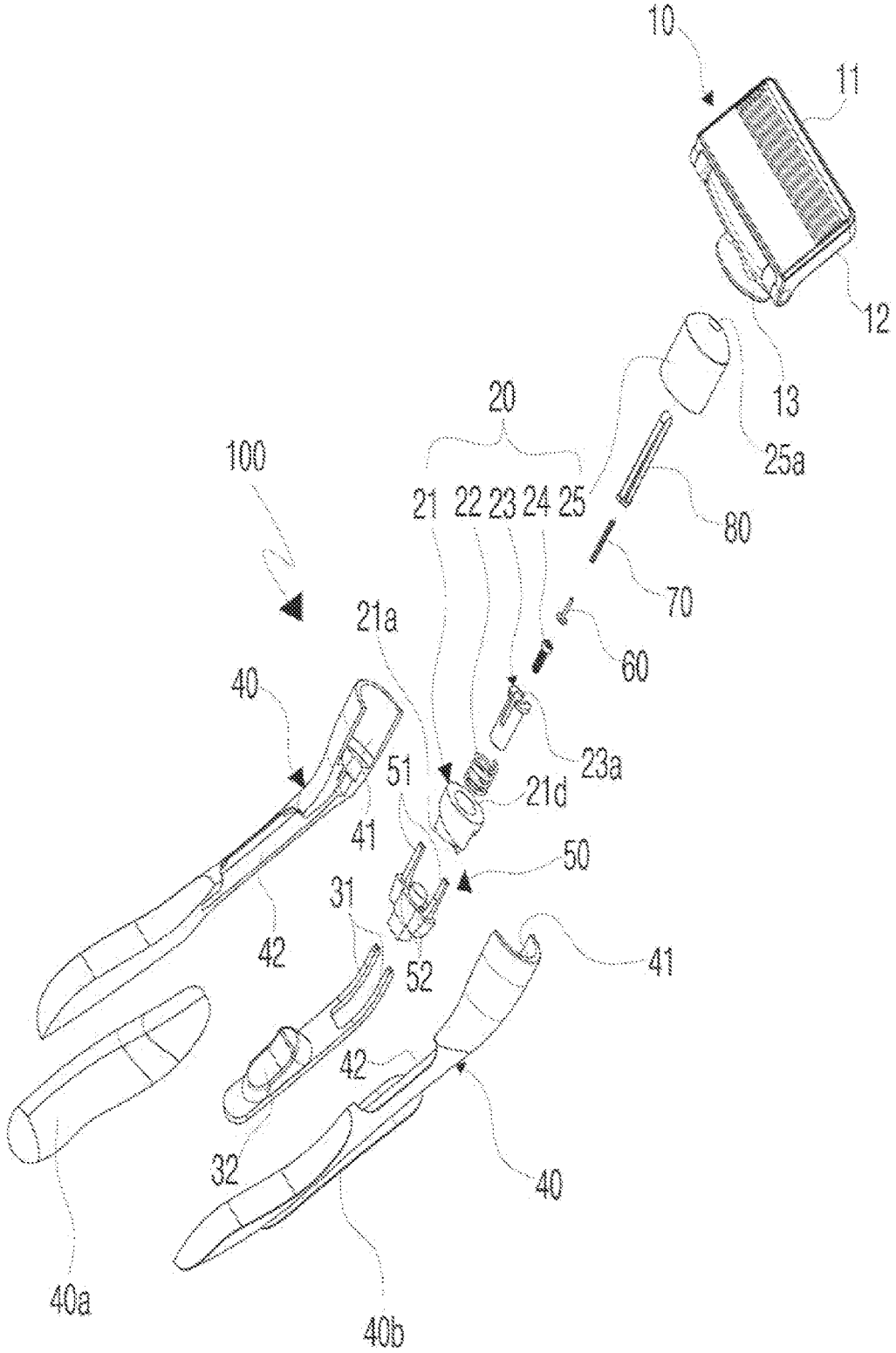

[Fig.2]
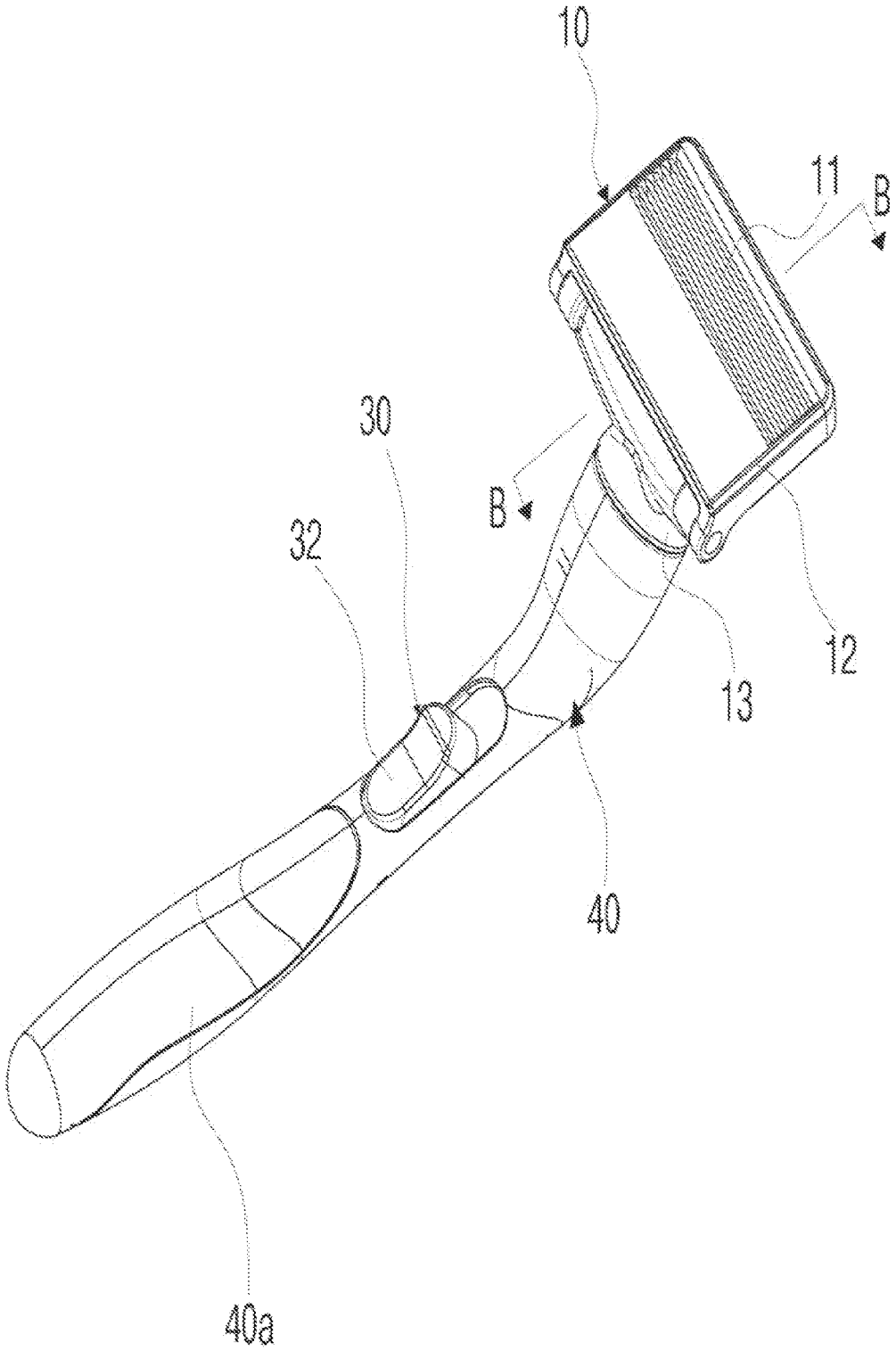

[Fig.3]
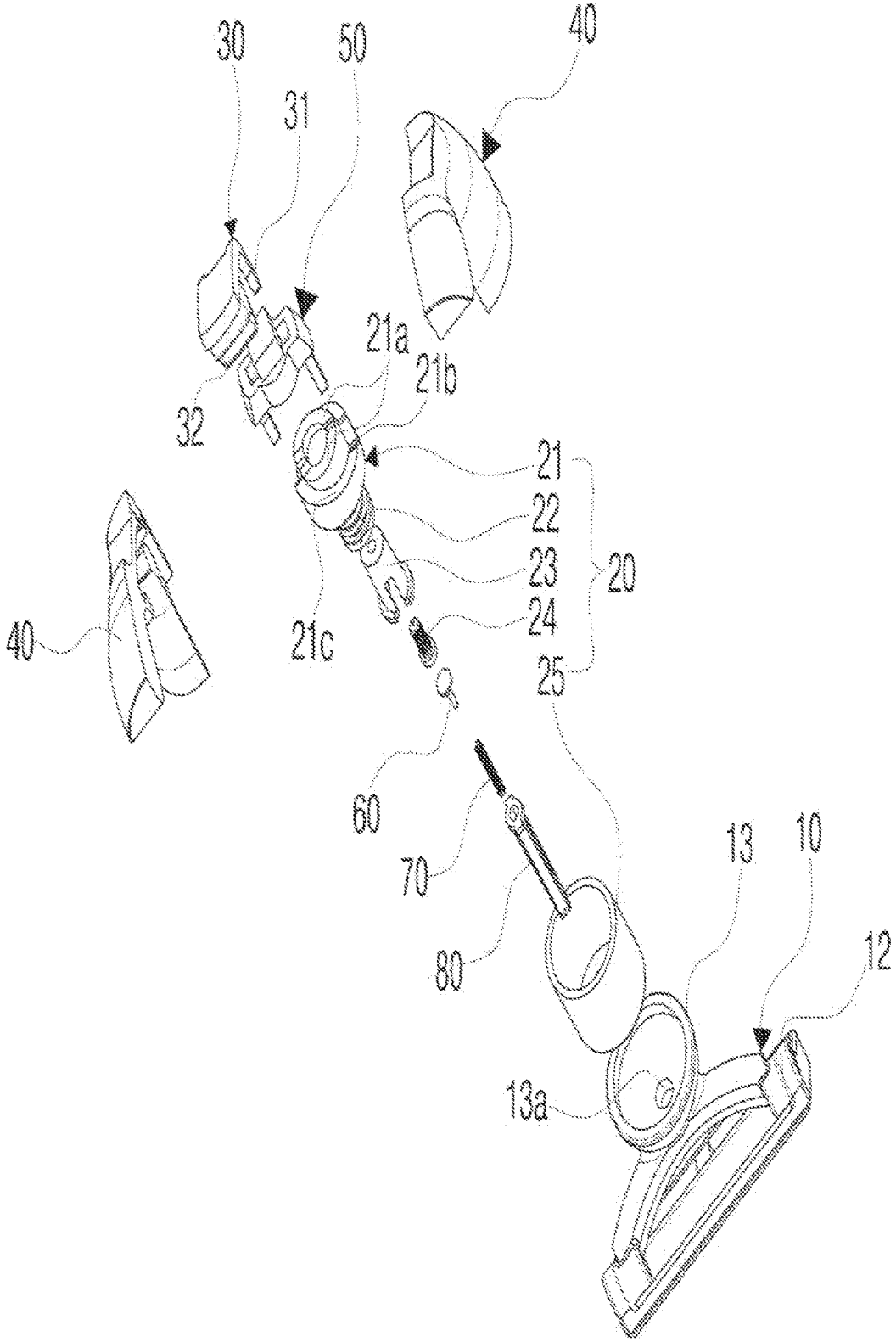

[Fig.4]
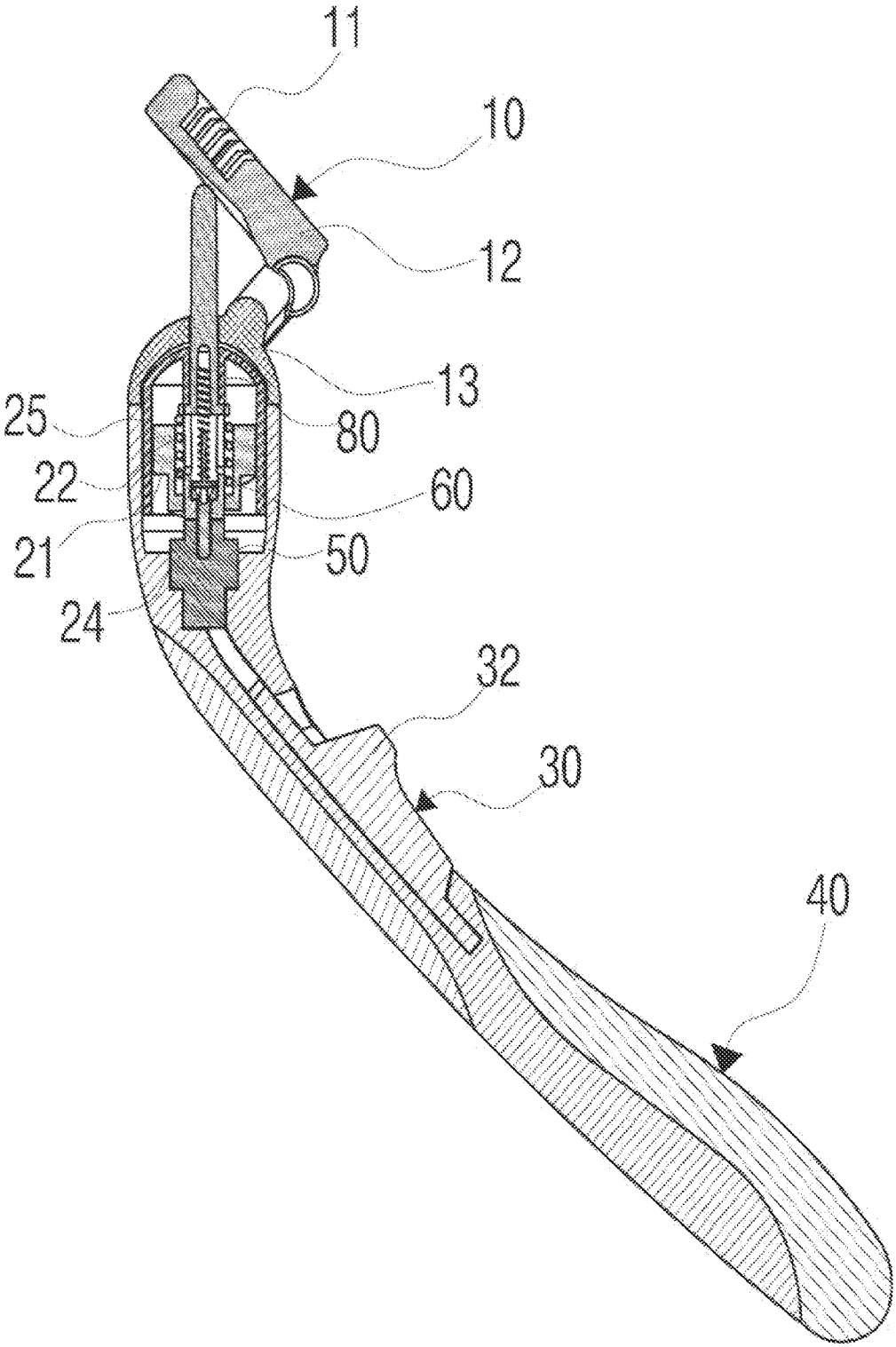

[Fig.5]
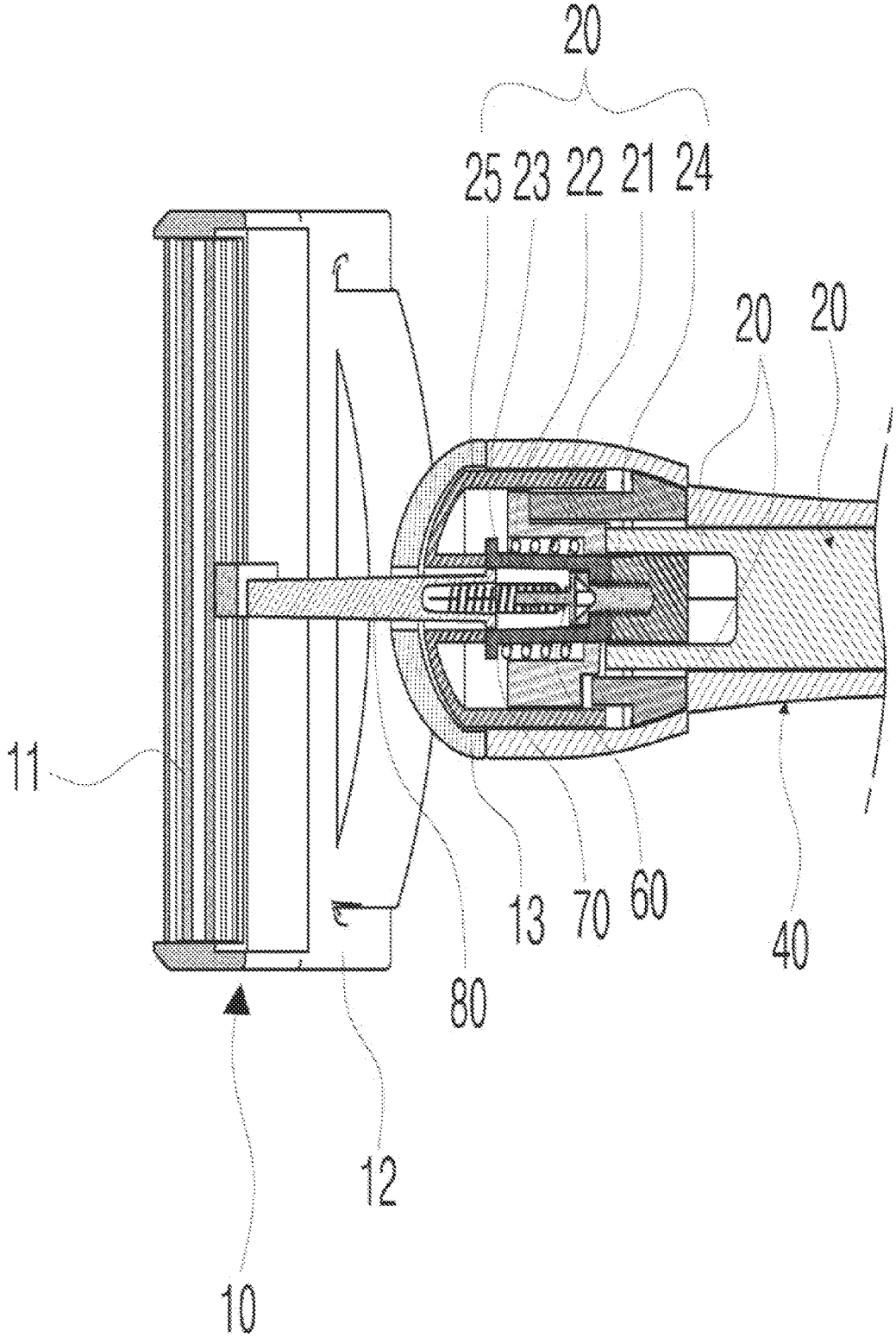

[Fig.6]
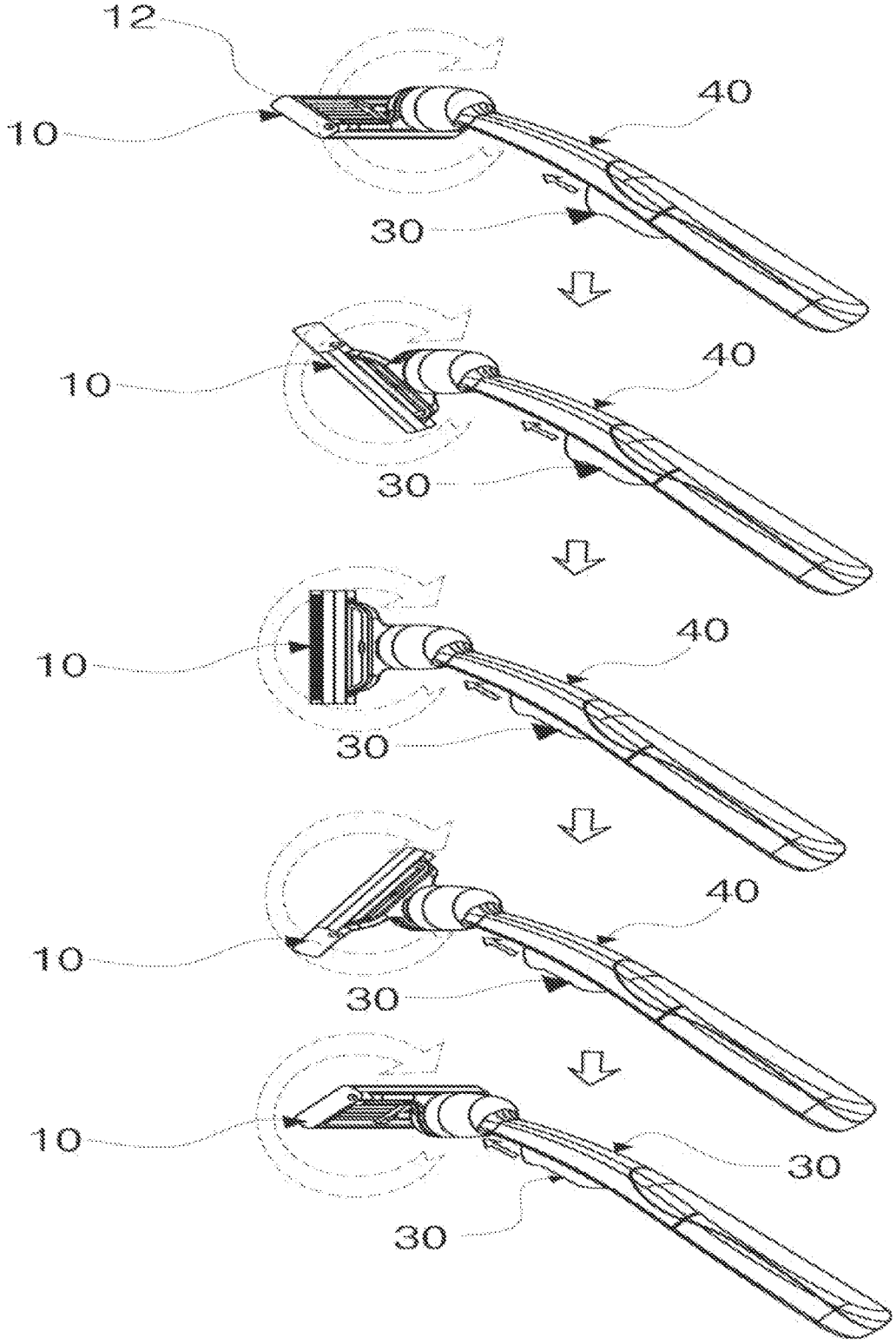

[Fig.7]
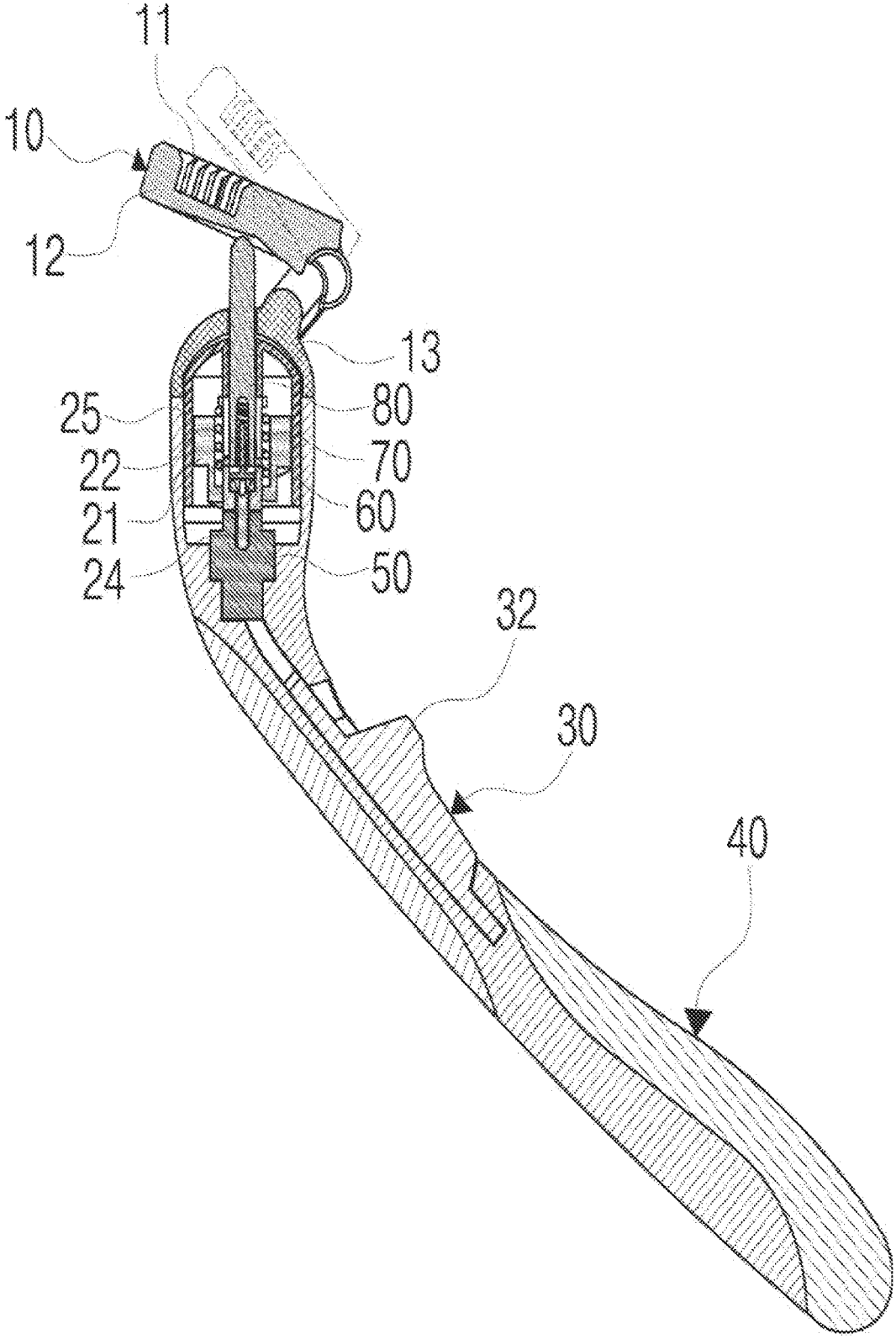

[Fig.8]
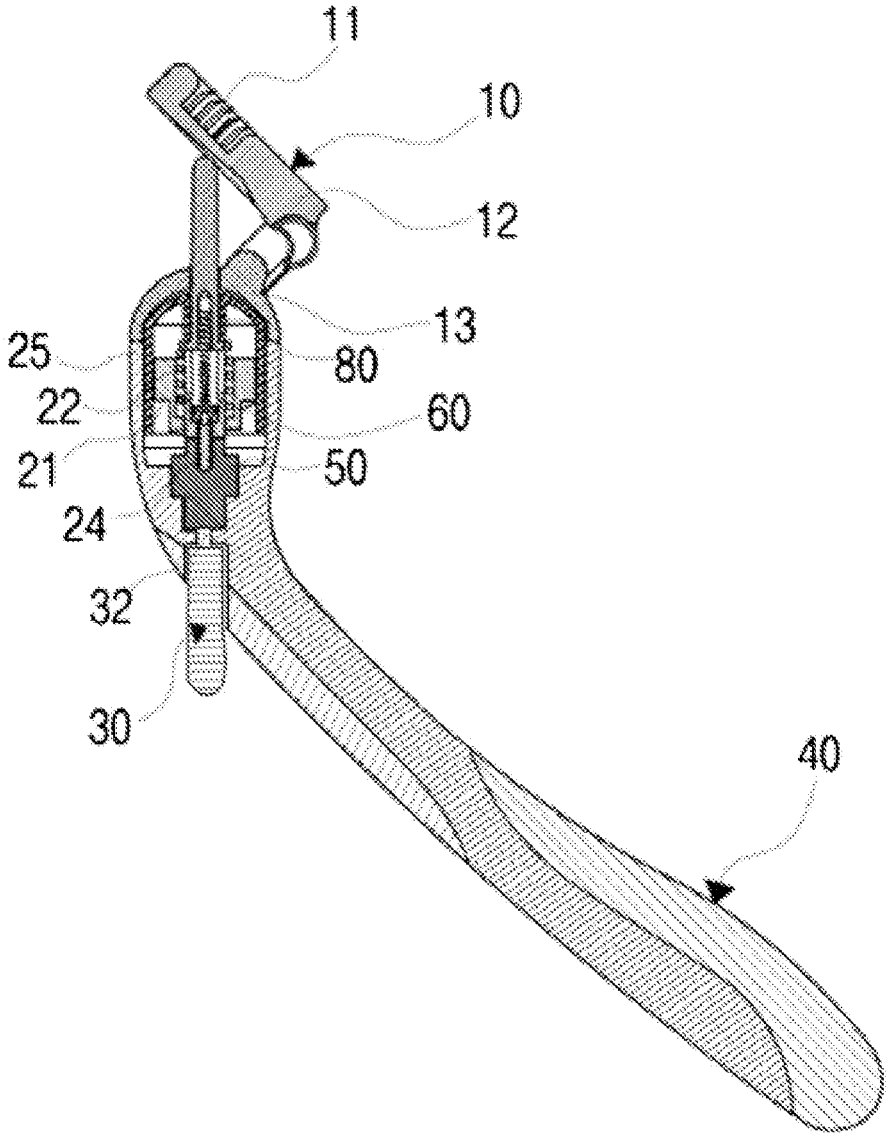

ROTATING TYPE RAZOR

CROSS REFERENCE TO PRIOR APPLICATIONS

This application is a National Stage Application of PCT International Patent Application No. PCT/KR2013/007750 filed on Aug. 29, 2013, under 35 U.S.C. §371, which claims priority to Korean Patent Application No. 10-2012-0116235 filed on Oct. 18, 2012, which are all hereby incorporated by reference in their entirety.

TECHNICAL FIELD

The present invention relates to a razor and, more particularly, to a rotating type razor in which a razor blade cartridge may be rotated by a mover so as to be variable in position in a state in which a handle of the razor is fixed when shaving the upper jaw and when shaving the lower jaw.

BACKGROUND ART

In general, a razor serves to shave hair of the face, such as fine hairs, beards, sideburns, etc., and is composed of a handle for gripping and a razor blade cartridge having a razor blade to perform shaving in contact with the skin. There are a replaceable razor in which the handle and the cartridge are separable and an integrated razor in which the handle and the cartridge are integrated with each other.

The razor blade cartridge usually includes a dual blade as a combination of two razor blades and, in recent years, triple and more blades are used.

For example, when a razor blade cartridge having two razor blades is mounted to the razor, one razor blade will primarily shave long body hair and, thereafter, the other razor blade will shave the primarily shaved body hair to a shorter length, assisting a user in maintaining a smooth shave.

In addition, in the case of a reusable razor that is widely used at home, it may be semi-permanently used via replacement of only a razor blade cartridge. Most users except for persons who have thick facial hair or a thick beard can normally use the razor for 30 days.

Considering a shaving procedure using the conventional razor as described above, usually, the user will first apply soap or shaving foam to the face and then hold the handle constituting a body of the razor with one hand to shave the beard or hair with a razor blade by moving the razor blade downward along the facial contour.

However, in the conventional razor, on the basis of a specific region of the face, i.e. the jaw of the face, it is adapted to be oriented upright to perform shaving via downward movement thereof when shaving the upper jaw and also adapted to be oriented upside down to perform shaving via upward movement thereof when shaving the lower jaw. Therefore, the user will have no great difficulty when shaving the upper jaw, but will experience inconvenience due to a constrained motion because the user has to hold the razor upside down when shaving the lower jaw.

In addition, such a constrained hand motion of the user who shaves by repeatedly moving the razor upward in a state in which the user holds the razor upside down causes deterioration in shaving performance.

In particular, since the constrained hand motion causes the razor blade to move askew rather than moving straightly, there is a problem in that the user nicks their skin with the razor blade. This consequently causes a vicious circle of bacteria invasion and skin damage due to the cut skin.

Reference is now made to Korean Utility Model Registration No. 20-0127018 of the related art, which discloses a disposable dual blade razor in which two cartridges, each of which receives a razor blade, are arranged at one side of a handle and attached to each other in two layers such that the razor blades fitted in the respective cartridges are arranged to face each other and oriented in opposite directions.

The razor of the related art as described above, however, exhibits considerable deterioration in shaving performance and has a risk of the user getting a cut on the skin by one razor blade while the other razor blade is shaving hair due to an arrangement in which the two razor blades facing each other are separately provided and come into close contact with each other.

In another example, reference is made to Korean Patent Registration No. 10-0764860, which discloses a rotating type razor and a shaving method using the same. The disclosed rotating type razor includes a first set of razor blades each having a surface defining a first plane, a second set of razor blades each having a surface defining a second plane, a short neck portion having a first end attached to a razor head and a second end, and an open cylindrical handle attached to the second end of the short neck portion, and the first and second sets of razor blades are coupled to the razor head.

The razor of the related art as described above allows the user to perform shaving by moving the razor head in symmetrical directions using the first set of razor blades and the second set of razor blades without orienting the razor upside down. This configuration, however, suffers from deterioration in shaving performance due to poor contact between the razor blades and the skin and has difficulty in providing reliable fixing of the razor blades.

DISCLOSURE

Technical Problem

Therefore, the present invention has been made in view of the above problems and it is an object of the present invention to provide a razor in which a razor blade cartridge, which receives razor blades, is rotatable relative to a handle of the razor to allow a user to perform shaving without holding the handle upside down when shaving the upper jaw and when shaving the lower jaw, which may solve any problem caused when the user performs shaving via a constrained motion of orienting the razor upside down when shaving the lower jaw.

Technical Solution

In accordance with an aspect of the present invention, the above and other objects can be accomplished by the provision of a rotating type razor comprising a handle provided at one side thereof, a head provided at the other side thereof, and a razor blade cartridge connected to the head, the razor further comprising a mover configured to rotate the razor blade cartridge, wherein the razor blade cartridge is rotated by 180 degrees about the head as a rotation axis by the mover so as to be variable in position when shaving the upper jaw and when shaving the lower jaw in a state in which a body of the razor has a fixed orientation.

In addition, the mover may include a rotating body unit having one end coupled to the razor blade cartridge, a button unit having one end configured to come into close contact with the rotating body unit, and a handle unit having a first receiving space in which the rotating body unit is received and a second receiving space in which the button unit is received, the handle unit being configured to outwardly expose a portion of the button unit received therein, wherein the button unit is configured to rotate the razor blade cartridge when moved forward toward the razor blade cartridge.

Advantageous Effects

The present invention has an effect of allowing even a user who is not accustomed to using a reversed handle to easily perform shaving because the user can rotate a razor blade cartridge by 180 degrees without orienting the handle upside down.

In addition, the present invention has an effect of achieving good shaving performance and convenience because there is no variation in the position of the handle when the user shaves the upper jaw and when the user shaves the lower jaw owing to the fact that the razor blade cartridge is rotatable.

In addition, the present invention has an effect of preventing the user from getting a cut on the skin and, consequently, preventing damage to the skin that has conventionally been caused when the user shaves the lower jaw in a state in which the user orients the handle of the razor upside down.

DESCRIPTION OF DRAWINGS

FIG. 1 is an exploded perspective view illustrating a rotating type razor according to an embodiment of the present invention.

FIG. 2 is a perspective view illustrating a coupled state of the rotating type razor illustrated in FIG. 1.

FIG. 3 is an exploded perspective view illustrating the rotating type razor illustrated in FIG. 1 when viewed from a different direction.

FIG. 4 is a longitudinal sectional view illustrating the rotating type razor illustrated in FIG. 2.

FIG. 5 is a partial sectional view taken along line B-B of FIG. 2.

FIG. 6 is a perspective view illustrating a sequence of pivotal rotation of a razor blade cartridge included in the rotating type razor illustrated in FIGS. 1 to 5.

FIG. 7 is a sectional view illustrating pivotal rotation of the razor blade cartridge illustrated in FIG. 4.

FIG. 8 is a view illustrating a configuration of the rotating type razor according to another embodiment of the present invention.

BEST MODE

Hereinafter, exemplary embodiments according to the present invention will be described in detail with reference to the accompanying drawings.

FIG. 1 is an exploded perspective view illustrating a rotating type razor according to an embodiment of the present invention. FIG. 2 is a perspective view illustrating a coupled state of the rotating type razor illustrated in FIG. 1. FIG. 3 is an exploded perspective view illustrating the rotating type razor illustrated in FIG. 1 when viewed from a different direction. FIG. 4 is a longitudinal sectional view illustrating the rotating type razor illustrated in FIG. 2. FIG. 5 is a partial sectional view taken along line B-B of FIG. 2. FIG. 6 is a perspective view illustrating a sequence of pivotal rotation of a razor blade cartridge included in the rotating type razor illustrated in FIGS. 1 to 5.

As exemplarily illustrated in FIGS. 1 to 5, the rotating type razor according to one embodiment of the present invention includes a razor blade cartridge 10 and a mover 100 to rotate the razor blade cartridge. The razor blade cartridge 10 is adapted to be rotated by 180 degrees about a razor head by the mover 100. As such, the razor blade cartridge is variable in position when shaving the upper jaw and when shaving the lower jaw in a state in which a body of the razor has a fixed orientation.

The mover 100 includes a rotating body unit 20, a button unit 30, and a handle unit 40.

The razor blade cartridge 11 may include razor blades 11, a razor blade fixing structure 12, and a rotatable coupler 13.

The razor blades 11 each may take the form of a plate having a bladed end and may be spaced apart from one another.

The razor blade fixing structure 12 provides a fixing space in which ends of the razor blades 11 may be fixed. The razor blade fixing structure 12, as exemplarily illustrated in the drawings, may take the form of a rectangular frame. However, the present invention should not be limited to this shape of the razor blade fixing structure 12.

The rotatable coupler 13 has one end pivotally rotatably coupled to the razor blade fixing structure 12 using a pin and the other end defining a coupling region. The end of the rotatable coupler 13 for pin-coupling with the razor blade fixing structure 12 may have an angled plate shape and the other end of the rotatable coupler 13 may have a semispherical shape to define the coupling region therein. However, the present invention should not be limited to this shape of the rotatable coupler 13.

The rotating body unit 20 may include a rotating cylinder 21, a first elastic member 22, a coupling member 23, a coupling bolt 24, and a connector 25.

The rotating cylinder 21 is configured as a circular cylinder and is provided at one end thereof with a curved surface 21*a*. Here, the curved surface 21*a* is configured as a depth varying groove formed in one end of the circular cylinder. In addition, the rotating cylinder 21 has an insertion space 21*d* defined in a central region of a body thereof for insertion of the first elastic member 22. In addition, the rotating cylinder 21 is formed with an expanded portion at the outer circumference of the body thereof and stop recesses 21*b* are formed in the expanded portion. In this case, the rotating cylinder 21 further has a sliding surface 21*c* extending between the stop recesses 21*b*.

The first elastic member 22 is inserted into the insertion space of the rotating cylinder 21. The first elastic member 22 may have a spiral coil shape.

The coupling member 23 is configured to come into close contact with the first elastic member 22. In this case, the coupling member 23 may be inserted into the insertion space of the rotating cylinder 21 in a state in which part of a body thereof has been inserted into the first elastic member 22. The coupling member 23 may come into close contact with the first elastic member 22 in a state in which the other end thereof is outwardly expanded. In addition, the body of the coupling member 23 may be centrally formed with an insertion region 23*a* into which the coupling bolt 24 as described below is inserted.

The coupling bolt 24 is fastened to the rotating cylinder 21 or a detent member 50 by passing through the coupling member 23. The coupling bolt 24 serves to prevent the coupling member 23 from being moved from the rotating cylinder 21 by a predetermined distance or more.

The connector 25 is configured as a rotating cylinder having one open end. The end of the connector 25 is coupled to the rotatable coupler 13 and the other end of the connector 25 is coupled to the rotating cylinder 21. In this case, the connector 25 may be coupled to the rotatable coupler 13 and the rotating cylinder 21 via, for example, fitting, bonding, or fusing.

The button unit 30 is configured to come into close contact, at one end thereof, with the curved surface 21*a* of the rotating body unit 20. The button unit 30 may have bar-shaped protruding pins 31 formed at the end thereof and a button-shaped protrusion 32 formed at a portion of a body thereof.

The handle unit 40 has a first receiving space 41 in which the rotating body unit 20 is received and a second receiving space 42 in which the button unit 30 is received. In this case, a region of the button unit 30 is exposed to the outside of the handle unit 40. In the present embodiment, the handle unit 40 is divided into a left handle and a right handle, which are separable from each other in opposite longitudinal directions on the basis of the center of the handle unit 40. As such, the handle unit 40 may be shaped to easily receive the rotating body unit 20. In addition, the handle unit 40 may further include a silicone packing 40*a* for prevention of slippage and a coupling cover 40*b* for coupling of the separated handles.

Now, an operation of the razor as described above will be described. First, the user will perform shaving in a state as illustrated in FIG. 2 and the uppermost region of FIG. 5 in a state where the user holds the handle unit 40 with the hand.

In this case, the user shaves the beard above or below the lips by moving the razor downward.

At this time, when the user attempts to remove the beard at the lower jaw, the user will push the button unit 30 with the hand such that the button unit 30 is moved forward to the razor blade cartridge 10.

Thereby, the button unit 30 gradually pushes the curved surface 21*a* of the rotating cylinder 21. In this case, the curved surface 21*a* has a varying depth along the lower end surface of the rotating cylinder 21, thereby being rotated by the push force of the button unit 30. In this way, as exemplarily illustrated in FIG. 5, the razor blade cartridge 10 is rotated by 180 degrees to thereby be oriented upside down.

In this case, the user can shave the beard by moving the razor upward from the lower jaw in a state in which the razor blade cartridge 10 is oriented upside down.

As described above, the rotating type razor according to the embodiment of the present invention allows even a user who is not accustomed to using a reversed handle as in the related art to easily perform shaving because the user can rotate the razor blade cartridge 10 by 180 degrees without orienting the handle 40 upside down.

Meanwhile, the rotating type razor according to one embodiment of the present invention may further include the detent member 50. The detent member 50 is inserted into a receiving space of the handle unit 40. The detent member 50 has protruding pieces 51 formed at one end thereof and a portion of a body of the detent member 50 is expanded so as to be coupled to the handle unit 40 when received in the receiving space of the handle unit 40. In addition, the detent member 50 has a passage hole 52 formed in a body region thereof to allow passage of the button unit 30. The detent member 50 is variable in contact position with the sliding surface 21*c* during rotation of the rotating cylinder 21 in a state in which ends of the protruding pieces 51 come into close contact with the respective stop recesses 21*b*. Accordingly, the rotating body 21 is limited in rotation to a location where the protruding pieces 51 of the detent member 50 are inserted into the stop recesses 21*b*, which serves to prevent idle rotation of the rotating cylinder 21.

In another embodiment of the present invention, the rotating type razor further includes a fixing pin 60, a second elastic member 70, and a pressure pin 80.

FIG. 7 is a sectional view illustrating pivotal rotation of the razor blade cartridge 10 illustrated in FIG. 4.

In this case, the connector 25 further has a through-hole 25*a* formed in one end thereof and the rotatable coupler 13 further has a second through-hole 13*a* communicating with the through-hole 25*a*.

The fixing pin 60 is received in the connector 25 and comes into close contact with the coupling bolt 24. In this case, the fixing pin 60 as well as the coupling bolt 24 may be inserted into a region where the coupling member 23 is inserted. The fixing pin 60 provides a fixing region to which the second elastic member 70 as described below may be fixed.

The second elastic member 70 is received in the connector 25 and is connected to the fixing pin 60.

The pressure pin 80 has one end configured to come into close contact with the second elastic member 70 so as to receive elastic force from the second elastic member 70. The pressure pin 80 passes through the through-hole 25*a* to thereby come into close contact with the razor blade fixing structure 12 in a state in which a body portion of the pressure pin 80 is received in the connector 25.

Now, roles of the fixing pin 60, the second elastic member 70 and the pressure pin 80 will be described. First, when the rotating body unit 20 is moved forward in the space of the handle unit 40 via forward movement of the button unit 30, as described above, the razor blade cartridge 10 is rotated by the rotating body unit 20.

In addition, the pressure pin 80 is moved forward along with the rotating body unit so as to push the razor blade fixing structure 12 in a given direction, thereby serving to control the angle of the razor blades 11. In this case, the razor blade fixing structure 12 is elastically supported by elastic force of the second elastic member 70.

When performing shaving using the razor as described above, the user can easily control the angle of the razor blade cartridge 10 according to a shaving environment by controlling a forward movement distance of the button unit 30.

FIG. 8 illustrates another embodiment of the rotating type razor according to the present invention. The button unit 30 is formed to vertically extend from the detent member 50 rather than being formed at the handle unit 40.

That is, the button unit 30 of the mover 100 according to the present invention may be located at the handle unit 40, or may be located below the rotatable coupler 13 so as to be vertically connected to the detent member 50. At this time, when the button unit 30 is pushed such that the bar-shaped protruding pins 31 formed at one end of the button unit 30 come into close contact with a lower end surface of the detent member 50, the detent member 50 is pushed upward by the protruding pins 31, thereby causing the razor blade cartridge 10 to be rotated by 180 degrees.

As described above, the position of the button unit 30 may be modified in various ways without and not be limited so long as the button unit 30 may initiate operation of the detent member 50 by being moved (pushed).

The above description of the present invention is given by way of example. Hence, it will be clearly understood that the present invention should not be limited to the configuration as described above in detail. Accordingly, the technical protection range of the present invention should be determined by the scope of the appended claims. That is, the technical protection range of the present invention should be construed as including alterations, equivalents and substitutions of the components of the above-described embodiments.

The invention claimed is:

1. A rotating type razor comprising a handle unit provided at one side and a razor blade cartridge provided at another side, the razor further comprising a mover configured to rotate the razor blade cartridge, wherein the mover includes:

a rotating body unit having an end coupled to the razor blade cartridge;

a button unit having an end configured to come into close contact with the rotating body unit; and the handle unit having a first receiving space in which the rotating body unit is received and a second receiving space in which the button unit is received, the handle unit being configured to outwardly expose a portion of the button unit received therein, wherein the button unit is configured to rotate the razor blade cartridge when the button unit moves toward the razor blade cartridge, wherein the razor blade cartridge includes:

a razor blade;

a razor blade fixing structure configured to provide a fixing space in which the razor blade is fixed; and a rotatable coupler having an end pivotally rotatably pin-coupled to the razor blade fixing structure and another end defining a coupling region, wherein the rotating body unit includes:

a rotating cylinder having an insertion space formed in a central region thereof;

a first elastic member configured to be inserted into the insertion space of the rotating cylinder;

a coupling member inserted into the insertion space of the rotating cylinder and part of a body of the coupling member is inserted into the first elastic member;

a coupling bolt coupled to the rotating cylinder by passing through the coupling member; and a connector having an end coupled to the coupling region of the rotatable coupler and another end coupled to the rotating cylinder;

wherein the razor blade cartridge is rotated by 180 degrees about the handle unit as a rotation axis by the mover so as to be variable in position when shaving an upper jaw and when shaving a lower jaw in a state in which the move has a fixed orientation.

2. The rotating type razor according to claim 1, wherein the rotating body unit further has a curved surface, and wherein the button unit is configured to come into close contact with the curved surface of the rotating body unit, whereby the button unit pushes the curved surface to rotate the rotating body unit, thereby causing the razor blade cartridge to be rotated.

3. The rotating type razor according to claim 1, wherein the rotating cylinder is provided at an outer circumference thereof with a stop recess and a sliding surface connected to the stop recess, and wherein the razor further comprises a detent member inserted into the handle unit, the detent member being variable in contact position with the sliding surface during rotation of the rotating cylinder in a state in which an end thereof comes into close contact with the stop recess.

4. The rotating type razor according to claim 1, wherein the connector further has a first through-hole formed in an end thereof and the rotatable coupler coupled to the connector further has a second through-hole communicating with the first through-hole, wherein the razor further comprises:

a fixing pin received in the connector so as to come into close contact with the coupling bolt;

a second elastic member received in the connector so as to be connected to the fixing pin; and a pressure pin having an end configured to come into close contact with the second elastic member so as to receive elastic force from the second elastic member, the pressure pin passing through the first through-hole to thereby come into close contact with the razor blade fixing structure in a state in which a body portion of the pressure pin is received in the connector, and wherein the rotating body unit is moved forward in an inner space of the handle unit via forward movement of the button unit, and the pressure pin is moved forward along with the rotating body unit so as to push the razor blade fixing structure in a given direction, thereby controlling an angle of the razor blade.

* * * * *